US011667310B2

(12) United States Patent
Creunet

(10) Patent No.: US 11,667,310 B2
(45) Date of Patent: Jun. 6, 2023

(54) CONTROL DEVICE, CONTROL SYSTEM, RAILWAY VEHICLE AND ASSOCIATED CONTROL METHOD

(71) Applicant: ALSTOM Transport Technologies, Saintouen-sur-Seine (FR)

(72) Inventor: Christophe Creunet, Strasbourg (FR)

(73) Assignee: ALSTOM Transport Technologies, Saint-Ouen-sur-Seine (FR)

( * ) Notice: Subject to any disclaimer, the term of this patent is extended or adjusted under 35 U.S.C. 154(b) by 137 days.

(21) Appl. No.: 17/116,346

(22) Filed: Dec. 9, 2020

(65) Prior Publication Data

US 2021/0171073 A1 Jun. 10, 2021

(30) Foreign Application Priority Data

Dec. 10, 2019 (FR) ..... 19 14020

(51) Int. Cl.
*B61L 3/00* (2006.01)
*B61L 15/00* (2006.01)

(52) U.S. Cl.
CPC ..... *B61L 3/008* (2013.01); *B61L 15/0072* (2013.01)

(58) Field of Classification Search
CPC ..... B61L 3/008; B61L 15/0072
See application file for complete search history.

(56) References Cited

U.S. PATENT DOCUMENTS

2013/0046424 A1* 2/2013 Gallagher ..... B61C 17/00 701/19
2013/0073175 A1* 3/2013 Banerjee ..... B60W 20/50 701/99
2016/0075345 A1 3/2016 Sonnleitner et al.
2016/0129925 A1* 5/2016 Jensen ..... B61C 17/12 701/19
2018/0058354 A1* 3/2018 Linker ..... F02D 41/068
2020/0094690 A1* 3/2020 Sondur ..... B60L 1/003
2020/0207218 A1* 7/2020 Lavertu ..... B61C 7/04

FOREIGN PATENT DOCUMENTS

DE 202017105323 U1 9/2017
EA 201500083 A1 7/2016
EP 2 650 186 A2 10/2013
WO 2013/028375 A1 2/2013

OTHER PUBLICATIONS

French Search Report for French Patent Application No. 19 14020, dated Jul. 22, 2020 in 2 pages.

* cited by examiner

*Primary Examiner* — Peter D Nolan
*Assistant Examiner* — Demetra R Smith-Stewart
(74) *Attorney, Agent, or Firm* — Knobbe, Martens, Olson & Bear, LLP

(57) ABSTRACT

A control device is for at least two traction engines of a railway vehicle. The control device includes an estimation module configured to estimate a traction power requirement of the rail vehicle as a function of at least one position signal of the rail vehicle, a determination module configured to determine a required operating state of each engine based on the power requirement, an adaptation module configured to determine, from the required operating state of each engine, an adapted operating state of said engine as a function of at least one specific parameter relating to the operation of the rail vehicle, and an emission module configured to emit a control signal to each engine.

17 Claims, 2 Drawing Sheets

CONTROL DEVICE, CONTROL SYSTEM, RAILWAY VEHICLE AND ASSOCIATED CONTROL METHOD

CROSS-REFERENCE TO RELATED APPLICATION

This application claims priority to French Patent Application No. 19 14020 filed on Dec. 10, 2019, the disclosure of which including the specification, the drawings, and the claims is hereby incorporated by reference in its entirety.

FIELD OF THE INVENTION

The present invention concerns a control device for at least two traction engines of a railway vehicle. The present invention also relates to a control system comprising such a control device, a railway vehicle and an associated control method.

BACKGROUND OF THE INVENTION

The invention relates to the field of control of traction engines of railway vehicles. In particular, the present invention relates to railway vehicles comprising a plurality of combustion engines, such as engines running on diesel fuel.

Control devices are known which are configured to modify the speed of rotation of the traction engines, also called engine speed, according to a traction power requirement for the railway vehicle.

For example, as the rail vehicle climbs higher, the engine rotation speed is increased, and as the rail vehicle descends, the rotation speed is reduced.

However, in known control devices, engines are often operated in areas of non-optimal rotational speeds in terms of mechanical wear and fuel consumption.

Thus, there is a need for a control device to achieve control of the traction engines of the rail vehicle in order to extend the service life of the engines and/or reduce fuel consumption.

SUMMARY OF THE INVENTION

For this purpose, the object of the present invention is a control device for at least two traction engines of a railway vehicle, the control device comprising:

- an estimation module configured to estimate a traction power requirement of the railway vehicle as a function of at least one position signal of the railway vehicle;
- a determination module configured to determine a required operating state of each engine based on the power requirement;
- an adaptation module configured to determine, from the required operating state of each engine, an adapted operating state of said engine according to at least one specific parameter relating to the operation of the railway vehicle;
- a transmitter module configured to transmit a control signal to each engine, the control signal comprising an adapted operating state command for each engine, received from the adapter module, the adapted operating state command being configured to control the operation of each engine in the adapted operating state of said engine, the estimating module being configured to receive statistical data of the power requirement as a function of the position of the rail vehicle and configured to estimate the power requirement additionally as a function of the statistical data.

According to other advantageous aspects of the invention, the control device comprises one or more of the following features, taken alone or in any technically possible combination:

- the specific parameter includes a control of the acceleration or deceleration of the railway vehicle;
- the adaptation module is configured to receive the acceleration or deceleration command generated in response to a command actuation by a driver of the railway vehicle;
- the specific parameter includes a measurement of the speed of the rail vehicle and/or the acceleration of the rail vehicle;
- the command of the adapted operating state is a command to start or stop at least one of the engines, and/or a command to change a speed of at least one of the engines;
- the control device further comprises a restriction module configured to set a minimum stop and/or run time of each engine and to transmit the minimum stop and/or run time of each engine to the adaptation module, the adaptation module being configured to determine the adapted operating state further according to the minimum stop and/or run time of each engine, received from the restriction module.
- the restriction module is further configured to determine a maximum number of engines that are stopped for a predefined period of time and to transmit the maximum number to the adaptation module, the adaptation module being configured to determine the adapted operating state further based on the maximum number received from the restriction module;
- the rail vehicle position signal is a signal obtained by a satellite positioning system.

The invention also relates to a control system comprising the control device as described above, the control system further comprising at least one rail vehicle position sensor configured to generate the rail vehicle position signal.

According to a particular embodiment of the invention, the control system furthermore comprises at least one status sensor configured to measure the specific parameter.

The invention also relates to a railway vehicle comprising a control system as described above and at least two traction engines.

The invention also relates to a method for controlling at least two traction engines of a railway vehicle, the method comprising:

- a step of estimating a traction power requirement of the rail vehicle based on at least one position signal of the rail vehicle using an estimation module configured to receive statistical data of the power requirement based on the position of the rail vehicle and configured to estimate the power requirement further based on the statistical data;
- a step of determining a required operating state of each engine as a function of the power requirement;
- an adaptation step, in which, from the required operating state of each engine, an adapted operating state of said engine according to at least one specific parameter relating to the operation of the railway vehicle is determined;
- a step of outputting a control signal to each engine, the control signal comprising a command of the adapted operating state of each engine, received in the adaptation step, the command of the adapted operating state being configured to control the operation of each engine in the adapted operating state of said engine.

BRIEF DESCRIPTION OF THE DRAWINGS

These features and advantages of the invention will appear when reading the following description, given only as an example and not as an exhaustive example, and made with reference to the appended drawings, on which.

DETAILED DESCRIPTION OF THE PREFERRED EMBODIMENTS

Figure 1:
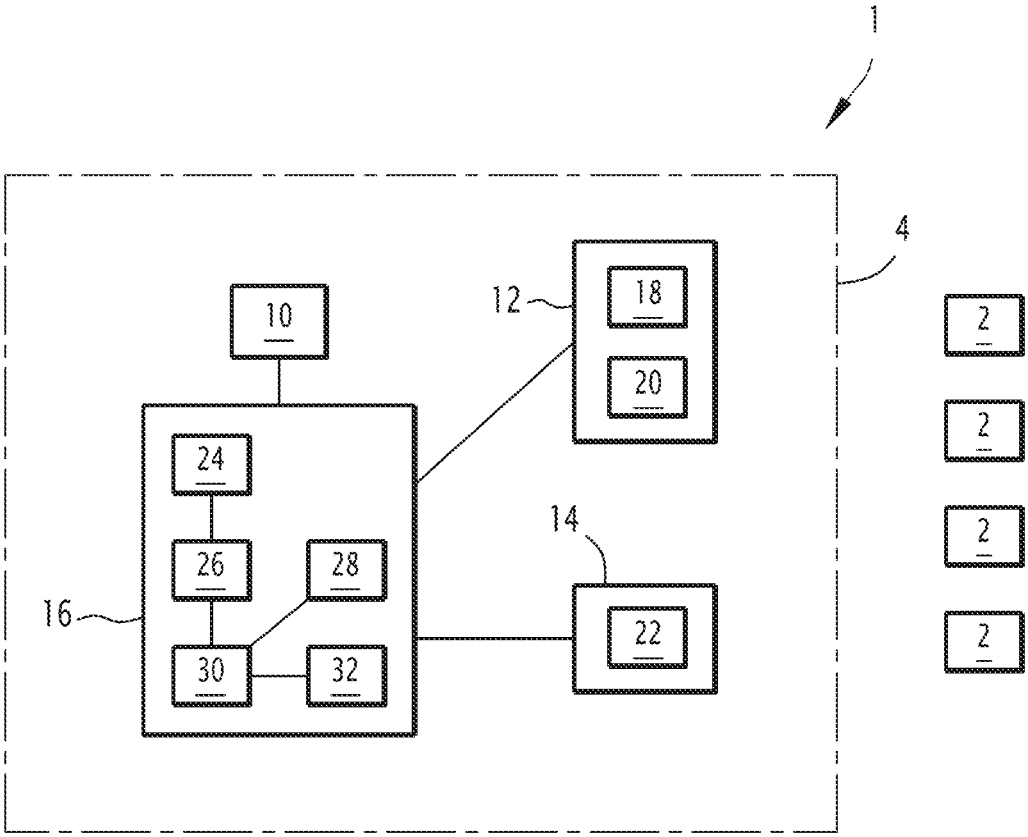
FIG. 1 is a schematic representation of a part of a railway vehicle comprising a control device.

With reference to FIG. 1, a part of a railway vehicle 1 comprises a plurality of engines 2 and a control system 4 of the plurality of engines 2.

The railway vehicle 1 comprises at least two engines 2, preferably three or more engines. According to the example in FIG. 1, railway vehicle 1 comprises four engines 2.

Engines 2 are traction engines of the railway vehicle 1, including combustion engines, such as diesel engines. Engines 2 are configured to generate traction force for rail vehicle 1.

According to the example in FIG. 1, control system 4 comprises at least one position sensor 10, at least one status sensor 12, at least one memory 14 and a control device 16.

The position sensor 10 is configured to measure an instantaneous position of rail vehicle 1 and to output a position signal of rail vehicle 1 representative of this instantaneous position.

Position Sensor 10 is, for example, a position sensor integrated in a satellite positioning system, such as a Global Positioning System (GPS) sensor. In another example, position sensor 10 is a sensor configured to detect the position of rail vehicle 1 by reading beacons placed in the track on which rail vehicle 1 is intended to travel. In another example, position sensor 10 is an odometer.

Status sensor 12 is configured to measure at least one specific parameter relating to the operation of rail vehicle 1.

The specific parameter includes, for example, an acceleration or deceleration control of rail vehicle 1. The acceleration or deceleration command is configured to be generated, for example, in response to a command actuation by a driver of the rail vehicle 1.

As example, the specific parameter includes a speed measurement of rail vehicle 1 and/or an acceleration measurement of rail vehicle 1.

In particular, the status sensor 12 is configured to measure an instantaneous value of the specific parameter related to the operation.

According to an embodiment, the status sensor 12 includes an angle sensor 18 configured to measure the angle of a gear lever (not shown) configured to be operated by the driver, relative to a predefined "neutral" angle of the gear lever, in which neither acceleration nor deceleration of the rail vehicle 1 is required. For example, when the gear lever is moved in a first direction relative to the "neutral" angle, acceleration is required by the driver of rail vehicle 1, and when the gear lever is moved in a second direction, opposite to the first direction, relative to the "neutral" angle, deceleration or braking is required.

Depending on the implementation mode, the status sensor 12 includes a sensor for the speed 20 of the rail vehicle 1 and/or the acceleration of the rail vehicle 1, in which case the specific parameter includes the acceleration or speed of the rail vehicle 1. This parameter is a parameter specific to the operation of the railway vehicle: e.g. when the railway vehicle 1 is heavily loaded with passengers or goods, or axle boxes have a high friction, the railway vehicle 1 is likely to accelerate, as a result of the traction power supplied, at an acceleration lower than that which would have been obtained in a situation where the railway vehicle 1 is less loaded or the axle boxes have a lower friction.

As shown in the example in FIG. 1, the state sensor 12 comprises several state sensors of different types. For example, Condition Sensor 12 includes Angle Sensor 18 and Speed or Acceleration Sensor 20 of Rail Vehicle 1. In another example, Condition Sensor 12 includes a single sensor or multiple sensors of the same type. In yet another example, rail vehicle 1 includes several status sensor 12.

Memory 14 of control system 4 contains a database 22 in which data is stored concerning one or more routes on which the rail vehicle 1 is likely to travel. For example, database 22 includes a digital map of the route including geographical positions of the route, and timetables of the route of the rail vehicle 1. In particular, database 22 includes, at each of a plurality of successive crossing points along the planned route, a timetable at which the rail vehicle 1 is expected at that point.

Memory 14, and more particularly database 22, also includes, for example, statistical data of a power requirement as a function of the position of railway vehicle 1. Statistical data are, for example, previously recorded data, and come, for example from simulations, tests or previously completed journeys.

The control device 16 is integrated, for example, in a computer (not shown). In this case, the control device 16 is at least partly in the form of software which can be executed by a processor and stored in a memory of the computer.

Alternatively or in addition, the control device 16 is at least partially integrated into a physical device, such as a programmable logic circuit, such as a Field Programmable Gate Array (FPGA), or as a dedicated integrated circuit, such as an Application Specific Integrated Circuit (ASIC).

The control device 16 comprises an estimation module 24, a determination module 26, an adaptation module 30 and a transmission module 32. In the example shown, control device 16 also includes a restriction module 28.

The estimating module 24 is configured to estimate a traction power requirement of rail vehicle 1 based on at least one position signal of rail vehicle 1.

For example, the estimation module 24 is configured to receive a position signal from the position sensor 10 including the current geographical position of the rail vehicle 1. The estimation module 24 is thus configured to use the current geographical position of the rail vehicle 1 to estimate a traction power requirement of the rail vehicle 1.

For example, the estimation module 24 is configured to receive statistical data of a power requirement based on the position of the rail vehicle 1 from the database 22. The estimation module 24 is configured to search for the geographical position of the rail vehicle 1 received from the position sensor 10 in the statistical data and thus estimate a current power requirement of the rail vehicle 1 based on the statistical data of the geographical position of the rail vehicle 1.

The determination module 26 is configured to determine a required operating state of each engine 2 of the rail vehicle 1 based on the traction power requirement as estimated by the estimation module 24.

An operating state of an engine 2 includes a binary state of the relevant engine 2, i.e. whether the relevant engine 2 is switched on or off. According to one example, the operating state also includes an engine 2 speed, also referred to as the number of revolutions of engine 2.

A required operating state is the operating state of the relevant engine 2 that is required at a certain point in time.

Namely, the determination module 26 is configured to receive the power requirement and to output the required operating state of each engine 2.

The restriction module 28 is configured to set a minimum stop and/or run time for each engine 2 and to transmit the minimum stop and/or run time for each engine 2 to the adaptation module 30.

The minimum duration is the period of time during which the relevant engine 2 is forced to remain switched on or off, i.e. in particular to remain in the same operating state.

In particular, restriction module 28 is configured to set the minimum stop/run time based on data from previous stops or starts of the relevant engine 2. For example, restriction module 28 is configured to receive as an input each change in the operating state of each engine 2, and is configured to store each change in the operating state for a predefined storage period, for example for ten minutes. For example, if the relevant engine 2 has been switched on or off a number of times greater than or equal to a defined threshold, for example twice, during the storage period, the restriction module 28 is configured to force engine 2 to remain in its current operating state. The restriction module 28 is further configured to remove such a constraint from an affected engine 2, for example, from the point in time when the engine operating state has been changed a number of times less than the set threshold, during the relevant storage period from that point in time.

In particular, restriction module 28 is configured to prevent the same engine 2 from being switched on and off repeatedly.

In one particular example, restriction module 28 is configured to define that an engine 2 must, after ignition, remain running for at least one minute, and/or when stopped, must remain stopped for at least one minute.

By determining a maximum number of engine 28 that can be shut down for a predefined period of time, the restriction module 28 prevents too many engines 2 from being shut down and not being ignited when traction power is required due to the minimum shutdown time defined for those engines 2.

According to an example, restriction module 28 is configured to determine a maximum number of engines 2 that are stopped for a predefined period of time and to transmit the maximum number to adaptation module 30.

The restriction module 28 is an optional module.

Adapter module 30 is configured to determine, from the required operating state of each engine 2, an adapted operating state of said engine 2 according to the specific parameter relating to the operation of the rail vehicle 1.

The adapted operating state is the operating state modified to take into account the specific parameter.

In particular, adapter module 30 is configured to receive the required operating state and the specific parameter as input, for example from status sensor(s) 12. For example, adapter module 30 is configured to receive the acceleration or deceleration command generated in response to a command actuation by the driver of rail vehicle 1.

In one example, the specific input parameter of adapter module 30 includes an acceleration/deceleration command and also an acceleration/deceleration measurement of the rail vehicle 1. In another example, the specific parameter includes only one of the acceleration/deceleration command and the acceleration/deceleration measurement.

According to one example, adapter module 30 is configured to determine the adapted operating state in addition to the minimum stop and/or run time of each engine 2 received from restriction module 28.

In one particular example, the adaptation module 30 is configured to determine the additionally adapted operating state based on the maximum number received from the restriction module 28.

For example, the transmitter module 32 is configured to receive the adapted operating state of each engine 2 from the adapter module 30.

The transmitter module 32 is configured to send a control signal to each engine 2. The control signal includes a command for the adapted operating state of each engine 2 received from the adapter module 32. The adapted operating state command is configured to control the operation of each engine 2 in the adapted operating state of that engine 2. For example, the adapted operating state command is a command to start or stop at least one of the engines 2 and/or a command to change a speed of at least one of the engines 2.

In other words, transmitter module 32 is configured to issue commands to start or stop engines 2 individually, and/or to change the rotational frequency of each of the engines 2 individually.

A method for controlling the engines 2 of rail vehicle 1 will now be described. The control method is implemented by control system 4, and in particular by control device 16.

The control method consists of an estimation step, a determination step, an adaptation step, a restriction step and an emission step.

In the estimation step, the estimation module 24 estimates the traction power requirement of rail vehicle 1 based on at least one position signal of rail vehicle 1.

For example, estimation module 24 receives a position signal from position sensor 10 that includes the current geographical position of the rail vehicle 1. The estimation module 24 uses the geographical position of the rail vehicle 1 to estimate a traction power requirement of the rail vehicle 1.

For example, estimation module 24 also receives statistical data of the power requirement as a function of the position of the rail vehicle 1 from database 22. Estimation module 24 looks up the geographical position of the rail vehicle 1 received from the position sensor 10 in the statistical data and estimates a current power requirement of the rail vehicle 1 based on the statistical data.

Figure 2:
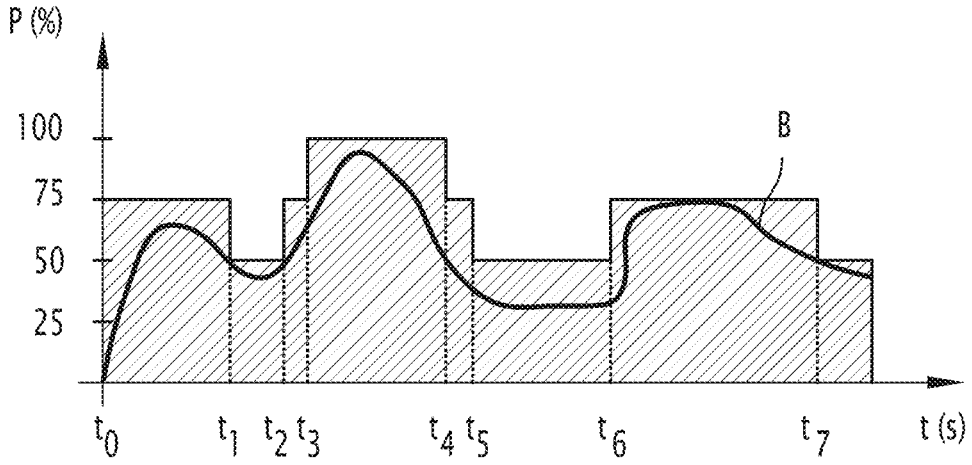
FIG. 2 is a schematic representation of the traction power provided by a plurality of engines of the rail vehicle according to FIG. 1.

An example of a power requirement B over time t is shown in FIG. 2. The power requirement B is estimated by the estimation module 24. The power requirement B is, for example, of the order of several kilowatts (kW).

For the purposes of this example, it is assumed that rail vehicle 1 has four engines 2 of equivalent power. A nominal traction power P of the four engines 2 together is defined as 100% power, so that each engine 2 is configured to provide 25% of the nominal traction power.

In the example in FIG. 2, from the time t0, the estimated power requirement B increases to approximately 60%. For example, between time t0 and time t1, rail vehicle 1 is accelerated or is positioned on a rising slope, and the statistical data thus indicate a high power requirement on this slope.

Between the times t1 and t2, the power requirement drops from about 50% to about 40%, for example in response to a downhill slope of the railway track. Between the times t3 and t4 the power requirement increases to about 87% at its maximum value and then decreases between t4 and t5 and then between t5 and 6 to a value of about 30%. Then the power requirement B increases again to approx. 70%, for example as a result of a rising gradient in the path of rail vehicle 1.

In the determination step, the determination module 26 determines a required operating state for each engine 2 according to the power requirement.

In particular, determination module 26 receives the power requirement and outputs the required operating state of each engine 2.

As an example, the determination module 26 determines the required operating state as follows.

With reference to FIG. 2, when the received power demand B is a maximum value of approximately 60% (period between t0 and t1) of the rated power, Determination Module 26 is configured to determine the required operating state "on" of three engines 2, and the required operating state "off" of the fourth engine 2. This results in a power output of 75% of the rated power.

When the received power requirement is no more than 50% of the rated power, determination module 26 determines the required "on" operating state of two engines 2, and the required "off" operating state of the other two engines 2 (time between t1 and t2). Further examples are possible.

In addition, the determination module 26 determines the speed of each switched on engine 2. For example, when the received power requirement is 87% of the rated power (time between t3 and t4), the determination module determines the rated speed for three engines 2 and half of the rated speed for a fourth engine 2 (corresponding to 12.5% of the rated power), to arrive at a tractive power of 87.5%. Other combinations are possible. In the restriction step, restriction module 28 defines a minimum stop and/or run time for each engine 2 and transmits the minimum stop and/or run time for each engine 2 to the adaptation module 30.

In an example, restriction module 28 determines a maximum number of engines 2 that are stopped for a predefined period of time and transmits the maximum number to the adaptation module 30.

For example, restriction module 28 determines the minimum stop/run time based on data from previous stops or starts of the respective engine 2. For example, restriction module 28 receives, as input, each change in the operating state of each engine 2, and stores each change in the operating state for a predefined storage period, for example during ten minutes. For example, if the relevant engine 2 has been switched on or off a number of times greater than or equal to a defined threshold, e.g. twice, during the storage period, the restriction module 28 forces engine 2 to remain in its current operating state. The restriction module 28 will remove such a constraint from an affected engine 2, for example from the point in time when the engine's operating state has been changed a number of times less than the set threshold, for the relevant storage period from that point in time.

In particular, the restriction module 28 prevents the same engine 2 from being switched on and off repeatedly. For example, the restriction module 28 defines that an engine 2 must, after ignition, remain running for at least one minute, and/or when stopped, must remain stopped for at least one minute.

In addition, the determination by the restriction module 28 of a maximum number of engine 2 that can be stopped for a predefined period of time, allows the restriction module 28 to prevent too many engine 2 from being stopped and not being ignited when traction power is required, due to the minimum stopping time defined for these engines 2.

During the adaptation step, adaptation module 30 determines the adapted operating state of each engine 2 from the required operating state of each engine 2 according to the specific parameter(s) relating to the operation of the rail vehicle 1.

In particular, the adaptation module 30 receives the required operating state and the specific parameter as input, for example from the status sensor(s) 12. For example, adapter module 30 receives the acceleration or deceleration command generated in response to a command actuation by the driver of the rail vehicle 1.

For example, when the specific parameter includes an acceleration or deceleration command from the rail vehicle 1, the adapter module 30 will change the required operating state in response to the acceleration command. For example, when the rail vehicle 1 is late with respect to the planned schedule of a journey and the driver wishes to move forward more quickly, he will give an acceleration command, thus increasing the B power requirement. As a result, for example, adapter module 30 is configured to change the "off" operating state of at least one engine 2 to the "on" operating state, known as the adapted operating state.

In one example, adapter module 30 also determines the adapted operating state based on the minimum stop and/or run time of each engine 2 received from restriction module 28.

In a particular example, the adaptation module 30 determines the adapted operating state additionally based on the maximum number received from the restriction module 28.

During the transmission step, the transmitter module 32 transmits the control signal to each engine 2. The control signal includes a command for the adapted operating state of each engine 2 received during the adaptation step. The adapted operating state command controls the operation of each engine 2 in the adapted operating state of that engine 2.

It is conceivable that the control device 16 can be used to obtain control of the traction engines 2 of the rail vehicle 1 in order to extend the service life of the engines 2 and/or reduce fuel consumption. Indeed, the operating life of engines 2 is reduced, as can be seen in the example in FIG. 2: in the period from t0 to t7, all engines 2 are only switched on in the period between t3 and t4.

In addition, because the control device 16 allows certain engine 2 to be switched off when the power requirement is low, the engine(s) 2 are configured to operate at an optimal speed in terms of fuel consumption. In particular, the control device 16 prevents the engines from running at a low rotational speed, as such a low speed leads to high consumption and/or high wear and tear on the engines 2.

At the same time, the control device 16 makes it possible to anticipate the power requirement, in particular thanks to the estimation module 24.

In addition, the driver of rail vehicle 1 remains in control of rail vehicle 1, as the adaptation module 30 makes it possible to adapt the operating state of engines 2 according to the specific parameter relating to the operation, including for example the acceleration or deceleration command generated in response to an actuation of the gear lever by a driver of rail vehicle 1. Gear lever actuation is measured, for example, by angle sensor 18. The control device 16 thus enables the driver's requirements (acceleration and deceleration) to be monitored, thus reducing fuel consumption and/or extending engine life.

What is claimed is:

1. A control device for at least two traction engines of a rail vehicle, the control device comprising:

an estimation module configured to estimate a traction power requirement of the rail vehicle as a function of at least one position signal of the rail vehicle;

a determination module configured to determine a required operating state of each engine based on the power requirement;

an adaptation module configured to determine, from the required operating state of each engine, an adapted operating state of said engine as a function of at least one specific parameter relating to the operation of the rail vehicle; and a transmitter module configured to transmit a control signal to each engine, the control signal comprising a command of the adapted operating state of each engine received from the adaptation module, the command of the adapted operating state being configured to control the operation of each engine in the adapted operating state of said engine, wherein the estimating module is configured to receive statistical data of the power requirement as a function of the position of the rail vehicle and configured to estimate the power requirement additionally as a function of the statistical data.

2. The control device according to claim 1, wherein the specific parameter comprises an acceleration or deceleration command of the rail vehicle, the adaptation module preferably being configured to receive the acceleration or deceleration command generated in response to an actuation of a command by a driver of the rail vehicle.

3. The control device according to claim 1, wherein the specific parameter comprises a measurement of speed of the rail vehicle and/or acceleration of the rail vehicle.

4. The control device according to claim 1, wherein the order of the adapted operating state is an order to start or stop at least one of the engines, and/or an order to change a rotational speed of at least one of the engines.

5. The control device according to claim 1, the control device further comprising a restriction module configured to set a minimum stop and/or run time of each engine and to transmit the minimum stop and/or run time of each engine to the adaptation module, the adaptation module being configured to determine the adapted operating state further according to the minimum stop and/or run time of each engine received from the restriction module.

6. The control device according to claim 5, wherein the restriction module is further configured to determine a maximum number of engines that are stopped for a predefined period of time and to transmit the maximum number to the adaptation module, wherein the adaptation module is configured to determine the adapted operating state further depending on the maximum number received from the restriction module.

7. A control system comprising the control device according to claim 1, the control system further comprising at least one sensor of a position of the rail vehicle, configured to generate the position signal of the rail vehicle.

8. The control system according to claim 7, further comprising at least one status sensor configured to measure the specific parameter.

9. A railway vehicle comprising the control system according to claim 7 and at least two traction engines.

10. A control method for at least two traction engines of a rail vehicle, the method comprising:

estimating a traction power requirement of the rail vehicle based on at least one position signal of the rail vehicle using an estimation module configured to receive statistical data of the power requirement based on the position of the rail vehicle and configured to estimate the power requirement further based on the statistical data;

determining a required operating state of each of said at least two engines according to the power requirement;

determining an adapted operating state of each of said at least two engines according to at least one specific parameter relating to the operation of the railway vehicle from the required operating state of each of said at least two engines;

outputting a control signal to each of said at least two engines, the control signal comprising a command of the adapted operating state of each of said at least two engines, the command of the adapted operating state controlling the operation of each of said at least two engines in the adapted operating state of said engine.

11. The control method according to claim 10, wherein the at least one specific parameter comprises an acceleration or deceleration command of the rail vehicle, the adaptation module preferably being configured to receive the acceleration or deceleration command generated in response to an actuation of a command by a driver of the rail vehicle.

12. The control method according to claim 10, wherein the at least one specific parameter comprises a measurement of speed of the rail vehicle and/or acceleration of the rail vehicle.

13. The control method according to claim 10, wherein the command of the adapted operating state is an order to start or stop at least one of the engines, and/or an order to change a rotational speed of at least one of the engines.

14. The control method according to claim 10, further comprising setting a minimum stop and/or run time of each of said at least two engines, wherein determining the adapted operating state of each of said at least two engines is further determined according to the minimum stop and/or run time of each of said at least two engines.

15. The control method according to claim 10, further comprising determining a maximum number of engines that are stopped for a predefined period of time wherein determining the adapted operating state of each of said at least two engines is further determined depending on the maximum number received from the restriction module.

16. The control method according to claim 10, further comprising generating a position signal of the rail vehicle.

17. The control system according to claim 16, further comprising measuring the specific parameter.

* * * * *